US007004888B1

(12) United States Patent
Weng

(10) Patent No.: US 7,004,888 B1
(45) Date of Patent: Feb. 28, 2006

(54) EXERCISER HAVING MAGNETIC RETARDING DEVICE

(76) Inventor: Yen Shu Weng, P.O.Box 63-298, Taichung (TW) 40699

( * ) Notice: Subject to any disclaimer, the term of this patent is extended or adjusted under 35 U.S.C. 154(b) by 0 days.

(21) Appl. No.: 11/027,741

(22) Filed: Jan. 3, 2005

(51) Int. Cl.
*A63B 22/06* (2006.01)

(52) U.S. Cl. ..... 482/57; 482/63

(58) Field of Classification Search ..... 482/51, 482/52, 56, 57, 60–63, 114, 115, 118, 119, 482/148
See application file for complete search history.

(56) References Cited

U.S. PATENT DOCUMENTS

| | | | | |
|---|---|---|---|---|
| 5,031,901 A | | 7/1991 | Saarinen | 272/73 |
| 5,094,447 A | | 3/1992 | Wang | 272/73 |
| 5,145,480 A | | 9/1992 | Wang | 482/63 |
| 5,466,203 A | * | 11/1995 | Chen | 482/63 |
| 6,095,953 A | * | 8/2000 | Lee et al. | 482/57 |
| 6,099,440 A | * | 8/2000 | Schurter et al. | 482/63 |
| 6,162,152 A | * | 12/2000 | Kuo | 482/63 |
| 6,491,606 B1 | * | 12/2002 | Swift | 482/57 |
| 6,569,063 B1 | * | 5/2003 | Chen | 482/63 |
| 6,612,970 B1 | * | 9/2003 | Forcillo | 482/57 |
| 6,852,070 B1 | * | 2/2005 | Herbert | 482/57 |
| 2005/0159274 A1 | * | 7/2005 | Chen | 482/63 |

* cited by examiner

*Primary Examiner*—Stephen R. Crow
*Assistant Examiner*—Tam Nguyen
(74) *Attorney, Agent, or Firm*—Charles E. Baxley

(57) ABSTRACT

An exerciser includes a flywheel rotatably attached onto a frame and coupled to a pair of foot pedals with a transmission device, an arch having one end rotatably coupled to the frame, one or more magnetic members attached to the arch and moveable toward or away from the flywheel, to adjust the magnetic retarding force to the flywheel. A brake shoe is attached to the other end of the arch, and movable to engage with and to brake the flywheel. A spring may bias the arch and the brake shoe away from the flywheel, to allow the brake shoe to be moved toward and against the flywheel and to brake the flywheel selectively. An actuating device may force the brake shoe of the arch to engage with and to brake the flywheel.

8 Claims, 8 Drawing Sheets

EXERCISER HAVING MAGNETIC RETARDING DEVICE

BACKGROUND OF THE INVENTION

1. Field of the Invention

The present invention relates to an exerciser, and more particularly to an exerciser having a magnetic retarding device for applying a magnetic retarding or resisting force against a flywheel, in order to allow users to suitably operate the exerciser with different strength.

2. Description of the Prior Art

Various kinds of typical exercisers, such as flywheel or cycle exercisers have been developed and comprise a flywheel rotatably supported on a base, a pair of crank-actuated foot pedals coupled to the flywheel, in order to rotate or drive the flywheel, and a magnetic retarding device attached to the base and disposed beside the flywheel, for applying a magnetic retarding or resisting force against the flywheel, and for allowing users to suitably operate the exerciser with different strength.

For example, U.S. Pat. No. 5,031,901 to Sarrinen discloses one of the typical cycle exercisers comprising an arch pivotally attached to a frame body of the exerciser, and permanent magnets attached to the arch, for allowing the permanent magnets to be moved or adjusted toward and away from a flywheel, and for allowing the magnetic retarding or resisting force applied onto the flywheel may be adjusted to different value.

However, the arch is coupled to a knob of a wire rope control device via a cover, and the cover is slidably engaged onto a wire rope, for allowing the knob to rotate the arch and thus to move the permanent magnets toward and away from the flywheel, so as to adjust the magnetic retarding or resisting force against the flywheel. Sarrinen discloses a complicated wire rope control device for the typical cycle exercisers. In addition, the permanent magnets may not be moved and forced to engage with the flywheel, and thus may not be used to solidly brake the flywheel.

U.S. Pat. No. 5,094,447 to Wang, and U.S. Pat. No. 5,145,480 to Wang disclose two of the typical cycle exercisers each also comprising an arch or a support pivotally attached to a frame body of the exerciser, to support permanent magnets, and to move or adjust the permanent magnets toward and away from the flywheel with a motorized control device, in order to adjust the magnetic retarding or resisting force applied onto the flywheel.

However, the motorized control device is complicated and may also be used to move or adjust the permanent magnets toward and away from the flywheel only, and the permanent magnets also may not be moved and forced to engage with the flywheel, and thus may not be used to solidly brake the flywheel.

The present invention has arisen to mitigate and/or obviate the afore-described disadvantages of the conventional cycle exercisers.

SUMMARY OF THE INVENTION

The primary objective of the present invention is to provide an exerciser including a magnetic retarding device for applying a magnetic retarding or resisting force against a flywheel, in order to allow users to suitably operate the exerciser with different strength.

The other objective of the present invention is to provide an exerciser including a magnetic retarding device capable of being forced onto and engaged onto the flywheel, in order to apply a solid brake force to brake the flywheel.

In accordance with one aspect of the invention, there is provided an exerciser comprising a frame, a flywheel rotatably attached onto and supported on the frame with a spindle, a pair of foot pedals, a transmission device coupling the foot pedals to the spindle of the flywheel, to allow the flywheel to be driven by the foot pedals, an arch including a first end rotatably coupled to the frame with a pivot pin, and including a second end, at least one magnetic member attached to the arch and moved in concert with the arch, to allow the magnetic member to apply magnetic retarding force against the flywheel, the arch being rotatable and movable toward or away from the flywheel, to adjust the magnetic member toward or away from the flywheel, and to adjust the magnetic retarding force applied to the flywheel, a brake shoe attached to the second end of the arch, and movable toward or away from the flywheel together with the arch, to selectively engage with and to brake the flywheel, a spring biasing device for biasing the arch and the brake shoe away from the flywheel, to resiliently space the brake shoe away from the flywheel, and to allow the brake shoe to be moved toward and against the flywheel and to brake the flywheel against the biasing device, and an actuating device slidably attached to the frame, and engageable with the arch, to selectively move and force the brake shoe of the arch to engage with and to brake the flywheel.

The actuating device includes a barrel engaged into a hole of the frame, and secured to the frame with fasteners. The barrel includes a fastener flange extended therefrom and secured to the frame with the fasteners.

The barrel includes a non-circular opening formed therein, and the actuating device includes a non-circular block slidably engaged into the non-circular opening of the barrel, and arranged for allowing the block to slide along the non-circular opening of the barrel, but to prevent the block from being rotated relative to the barrel.

The block includes a screw hole formed therein, to thread with the bolt, and to allow the bolt to be rotated and adjusted relative to the barrel and the block. The bolt includes a stop extended therefrom, for engaging with the barrel, and for limiting a sliding movement of the bolt relative to the barrel.

The bolt includes a knob secured on top thereof, for rotating the bolt relative to the block, and for moving the bolt and the block relative to the barrel. The bolt includes a thus cap attached to bottom thereof for engaging with the arch.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
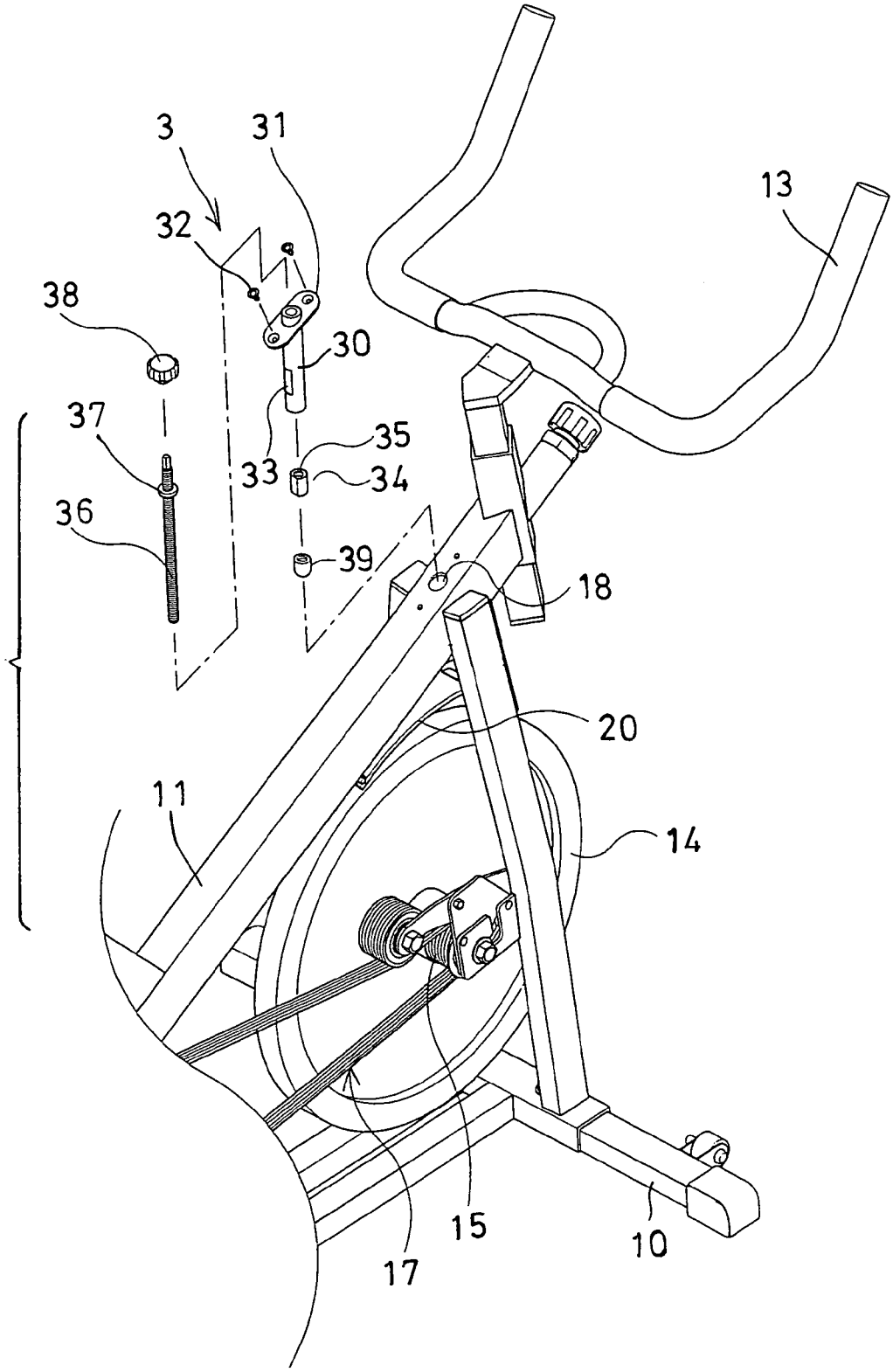
FIG. 1 is a partial exploded view of an exerciser in accordance with the present invention.
Figure 2:
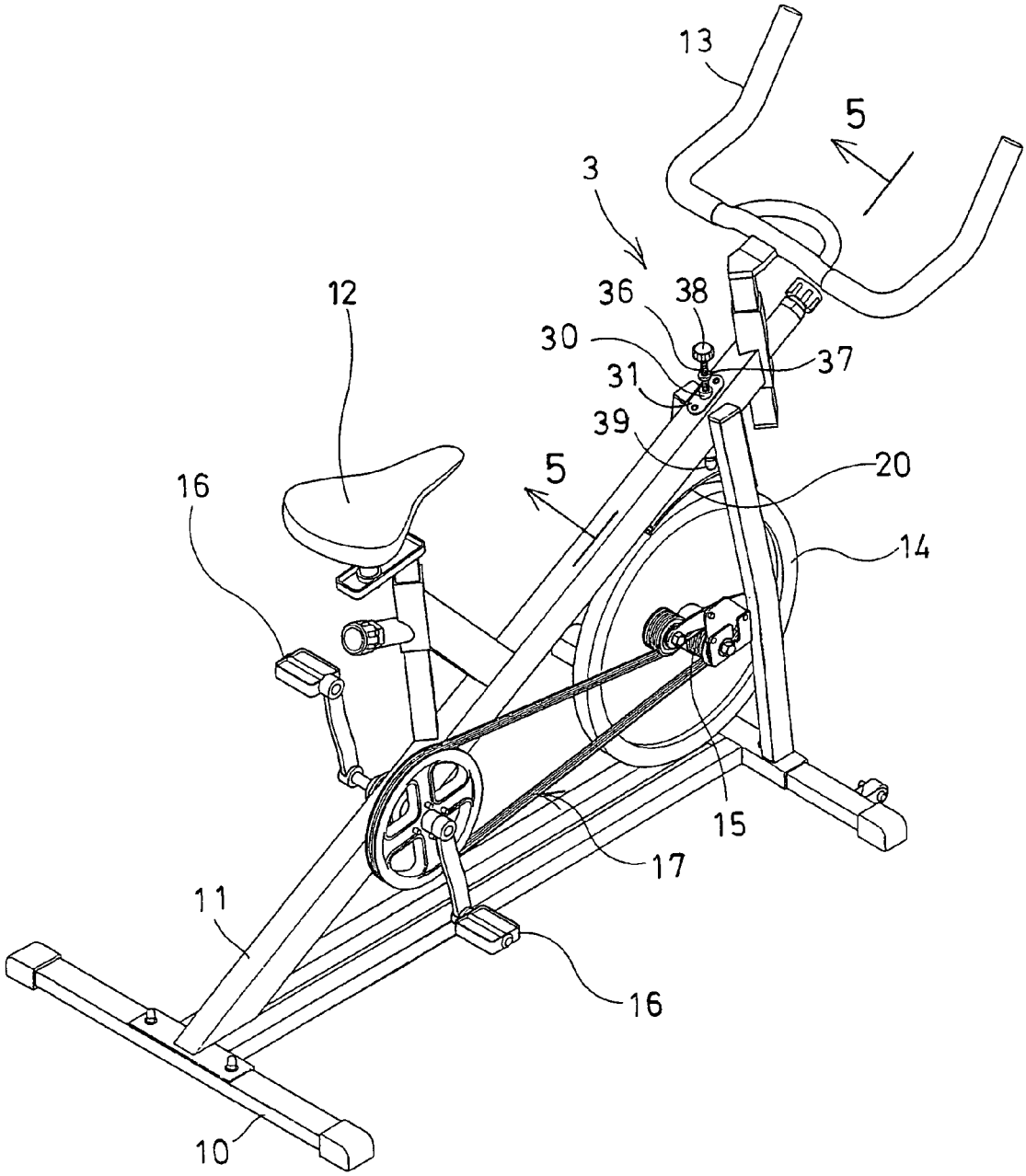
FIG. 2 is a rear perspective view of the exerciser.
Figures 3, 4:
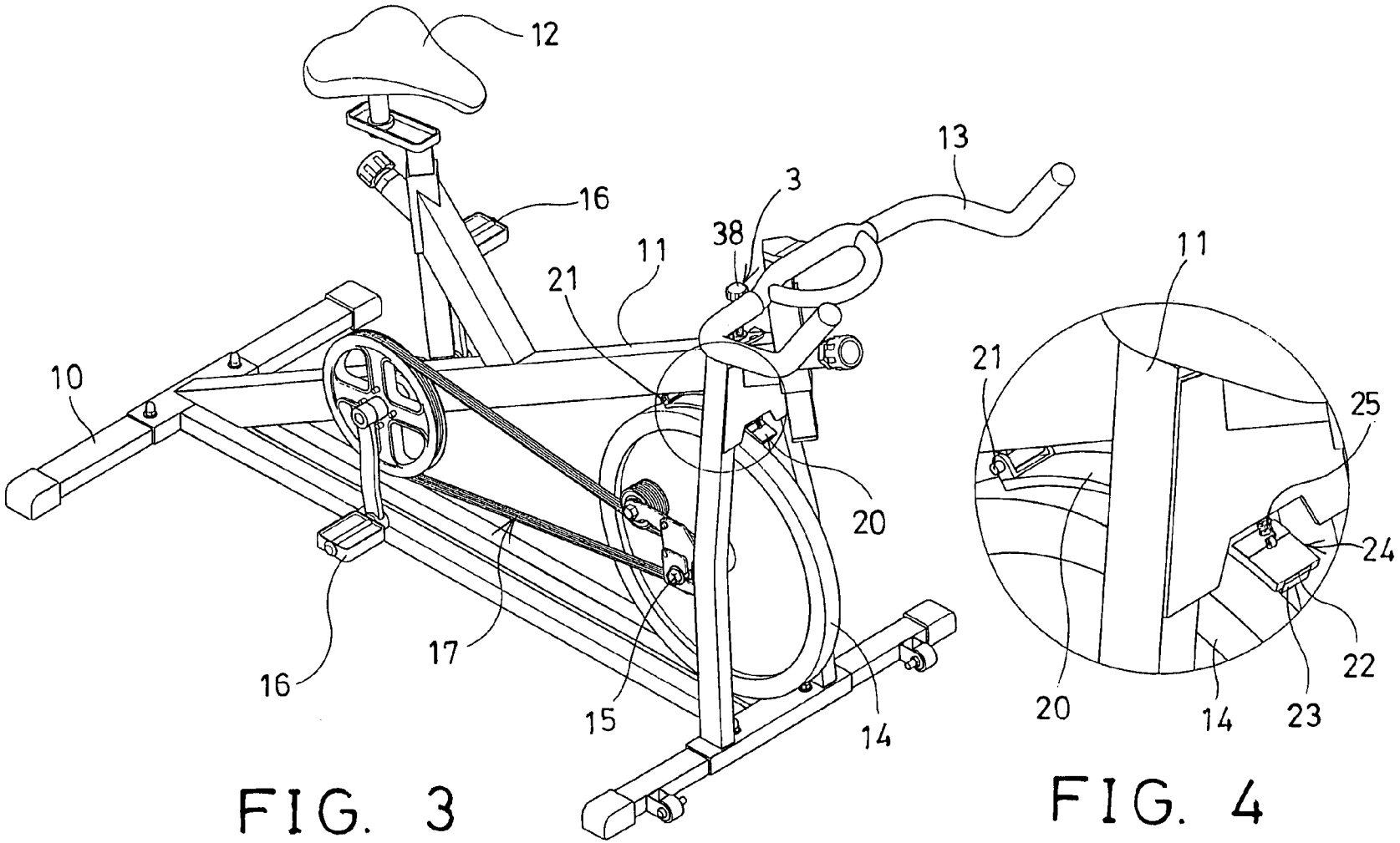
FIG. 3 is a front perspective view of the exerciser.
FIG. 4 is an enlarged partial front perspective view of the exerciser.

Referring to the drawings, and initially to FIGS. 1–5, an exerciser in accordance with the present invention comprises a frame 11 disposed and supported on a base 10, for supporting a seat 12 and/or a front handle 13 thereon, in order to support users thereon. A flywheel 14 is rotatably attached onto and supported on the frame 11 with a spindle 15, and a pair of foot pedals 16 coupled to the spindle 15 of the flywheel 14 with a transmission device 17, such as a crank-and-chain, pulley-and-belt, or gearing transmission device 17, in order to rotate or to drive the flywheel 14.

An arch 20 is preferably disposed above or around the flywheel 14, and includes one end rotatably or pivotally coupled to the frame 11 with a pivot pin 21, and includes one or more magnetic members 22 attached thereto and moved in concert with the arch 20, for applying magnetic retarding or resisting force against the flywheel 14. The arch 20 is rotatable and movable toward or away from the flywheel 14, to allow the magnetic members 22 to be moved toward or away from the flywheel 14, and thus to adjust the magnetic retarding force applied onto or against the flywheel 14.

The arch 20 further includes a brake shoe 23 attached to the other end 24 thereof, for being moved to engage with the flywheel 14, and to brake the flywheel 14 when required. A spring member 25 is coupled between the arch 20 and the frame 11, such as coupled between the other end 24 of the arch 20 and the frame 11, in order to bias or pull the brake shoe 23 away from the flywheel 14 (FIGS. 5–7), and to resiliently space the brake shoe 23 away from the flywheel 14, and to allow the brake shoe 23 to be forced or moved toward or against the flywheel 14 (FIG. 8) and to brake the flywheel 14 against the spring member 25, when required, such that the magnetic members 22 and the brake shoe 23 of the arch 20 may be useable for applying the magnetic retarding or resisting force against the flywheel 14, and for braking the flywheel 14.

An operating or actuating device 3 may be provided to operate and to actuate or to rotate and force the arch 20 to rotate relative to the frame 11 and the flywheel 14, and to move the magnetic members 22 and the brake shoe 23 of the arch 20 toward and away from the flywheel 14, in order to adjust the magnetic retarding force applied onto or against the flywheel 14 and/or to selectively move and force the brake shoe 23 to brake the flywheel 14 when required. For example, the actuating device 3 includes a barrel 30 engaged into a hole 18 of the frame 11, and having a fastener flange 31 extended therefrom and secured to the frame 11 with such as fasteners 32.

The barrel 30 is preferably disposed above or around the arch 20, and the barrel 30 includes an opening 33 formed therein and having a non-circular cross section. The actuating device 3 further includes a block 34 also having a non-circular cross section, for slidably engaging into the non-circular opening 33 of the barrel 30, and arranged for allowing the block 34 to slide up and down along the non-circular opening 33 of the barrel 30, but to prevent the block 34 from being rotated relative to the barrel 30. The block 34 includes a screw hole 35 formed therein.

A bolt 36 is rotatably engaged into the barrel 30, and threaded with the screw hole 35 of the block 34, and includes a stop 37 extended therefrom, for engaging with the barrel 30, and for limiting the movement of the bolt 36 relative to the barrel 30. A knob 38 is attached or secured on top of the bolt 36, for rotating the bolt 36 relative to the block 34, and thus to adjust the bolt 36 relative to the barrel 30. A rounded cap 39 is attached or secured to the bottom portion of the bolt 36, for smoothly engaging with the arch 20 (FIGS. 5–8), and for allowing the bolt 36 to force the arch 20 toward the flywheel 14 against the spring member 25 (FIG. 8).

Figure 5:
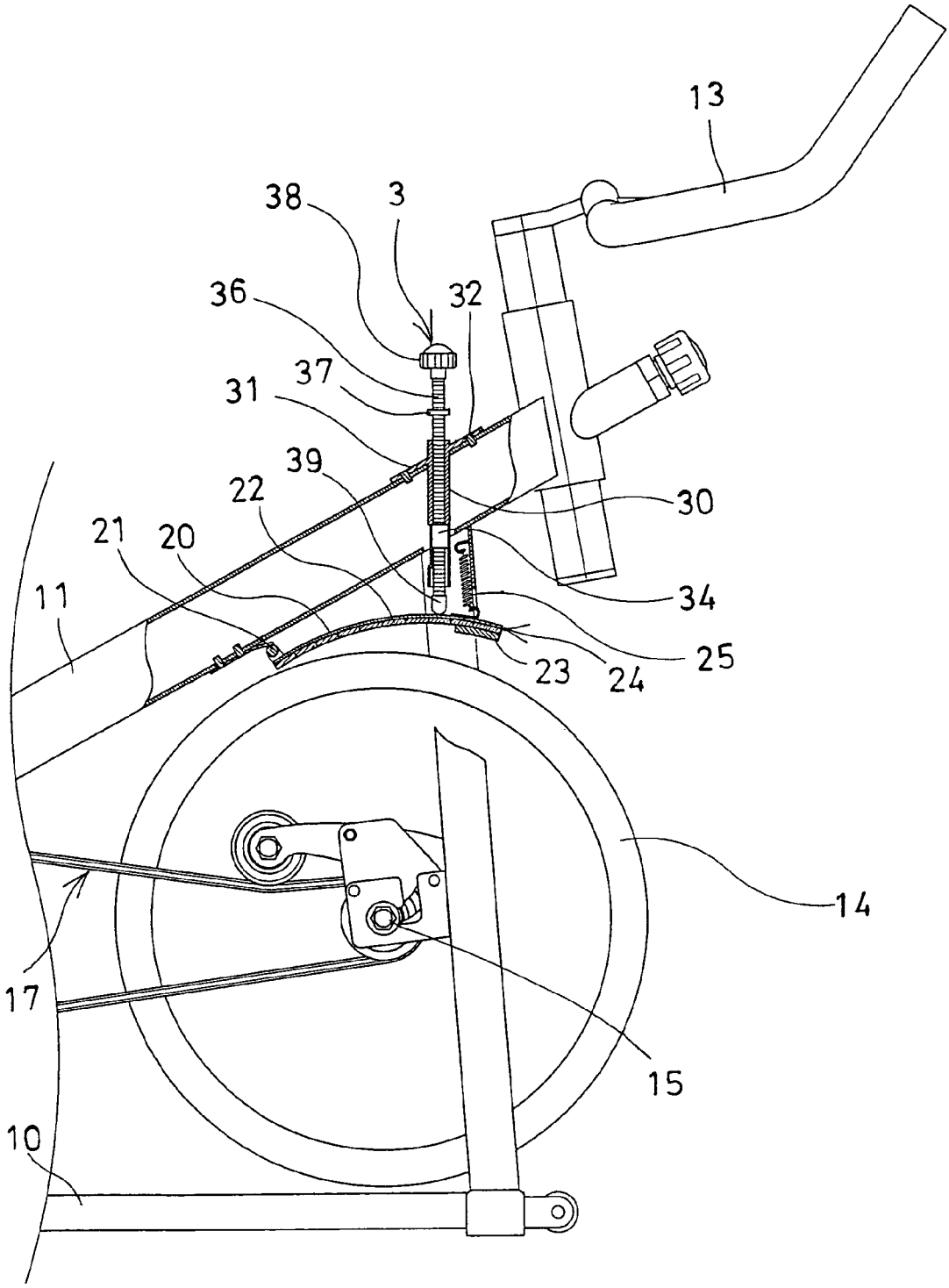
FIG. 5 is a partial cross sectional view of the exerciser, taken along lines 5—5 of FIG. 2.
Figure 6:
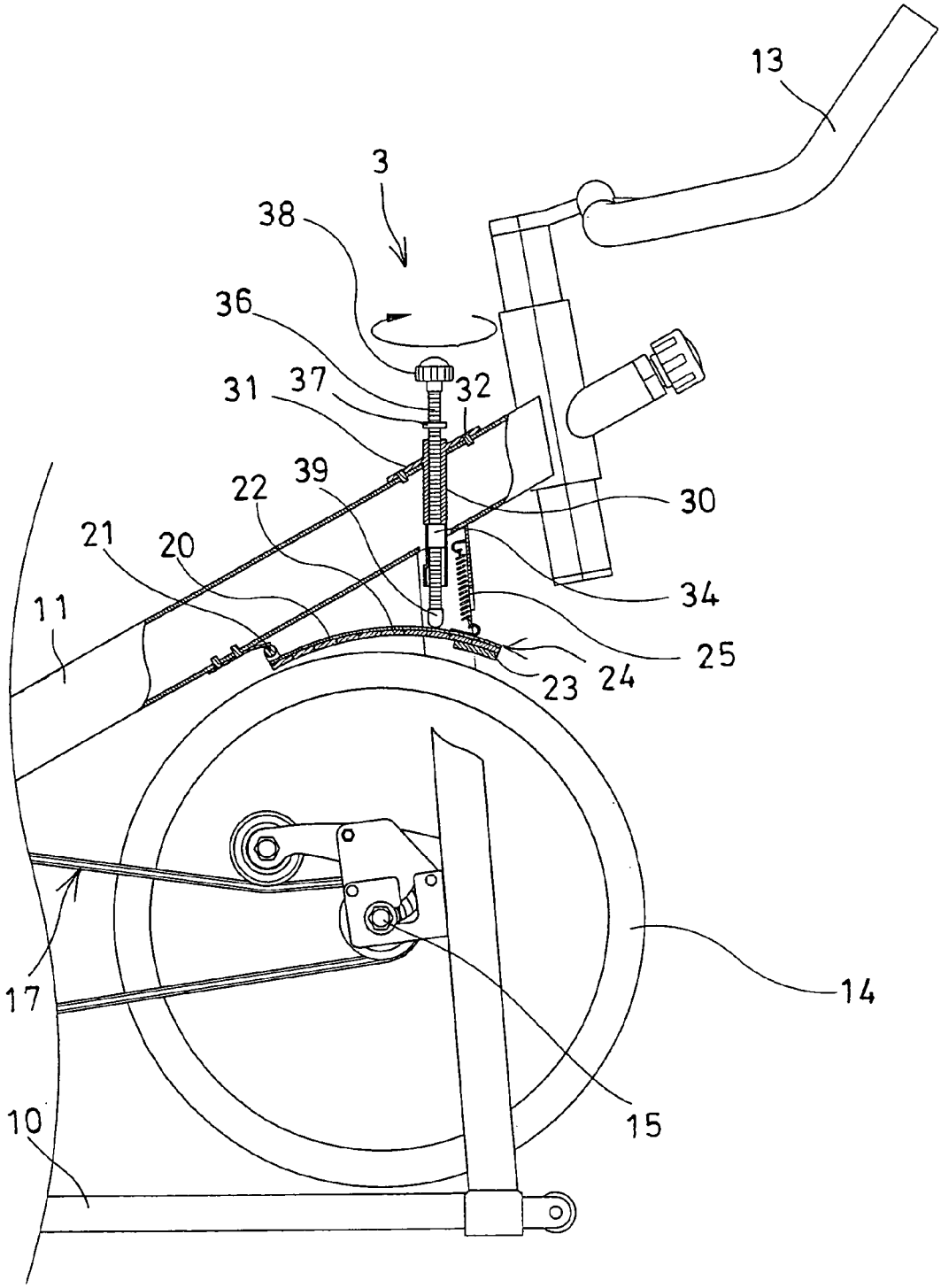
FIGS. 6, 7, 8 are partial cross sectional views similar to FIG. 5, illustrating the operation of the exerciser.

In operation, as shown in FIGS. 5 and 6, the cap 39 of the bolt 36 is engaged with the arch 20, such that the bolt 36 may also be forced or moved upwardly relative to the barrel 30 by the spring member 25, and such that the block 34 may also be forced to move upwardly toward an upper end or portion of the opening 33 of the barrel 30 by the spring member 25.

As shown in FIG. 6, when the bolt 36 is rotated or adjusted relative to the barrel 30, the bolt 36 may be rotated and adjusted relative to the block 34 due to the engagement of the non-circular block 34 in the non-circular opening 33 of the barrel 30, in order to adjust the cap 39 and thus the arch 20 relative to the frame 11 and the flywheel 14, such that the magnetic members 22 may be adjusted or moved toward or away from the flywheel 14, and thus to adjust the magnetic retarding force of the magnetic members 22 applied onto or against the flywheel 14.

Figure 7:
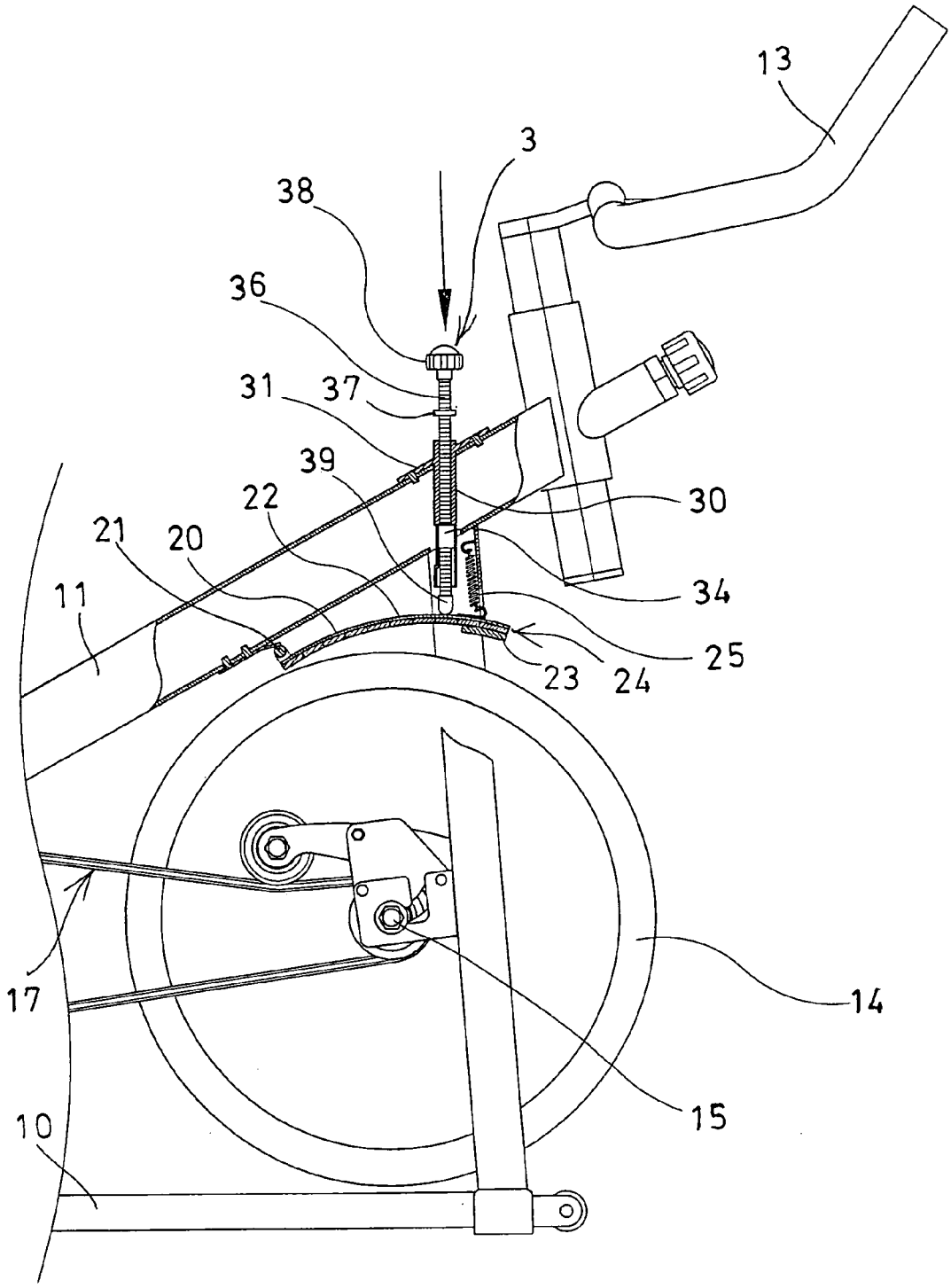
Figure 8:
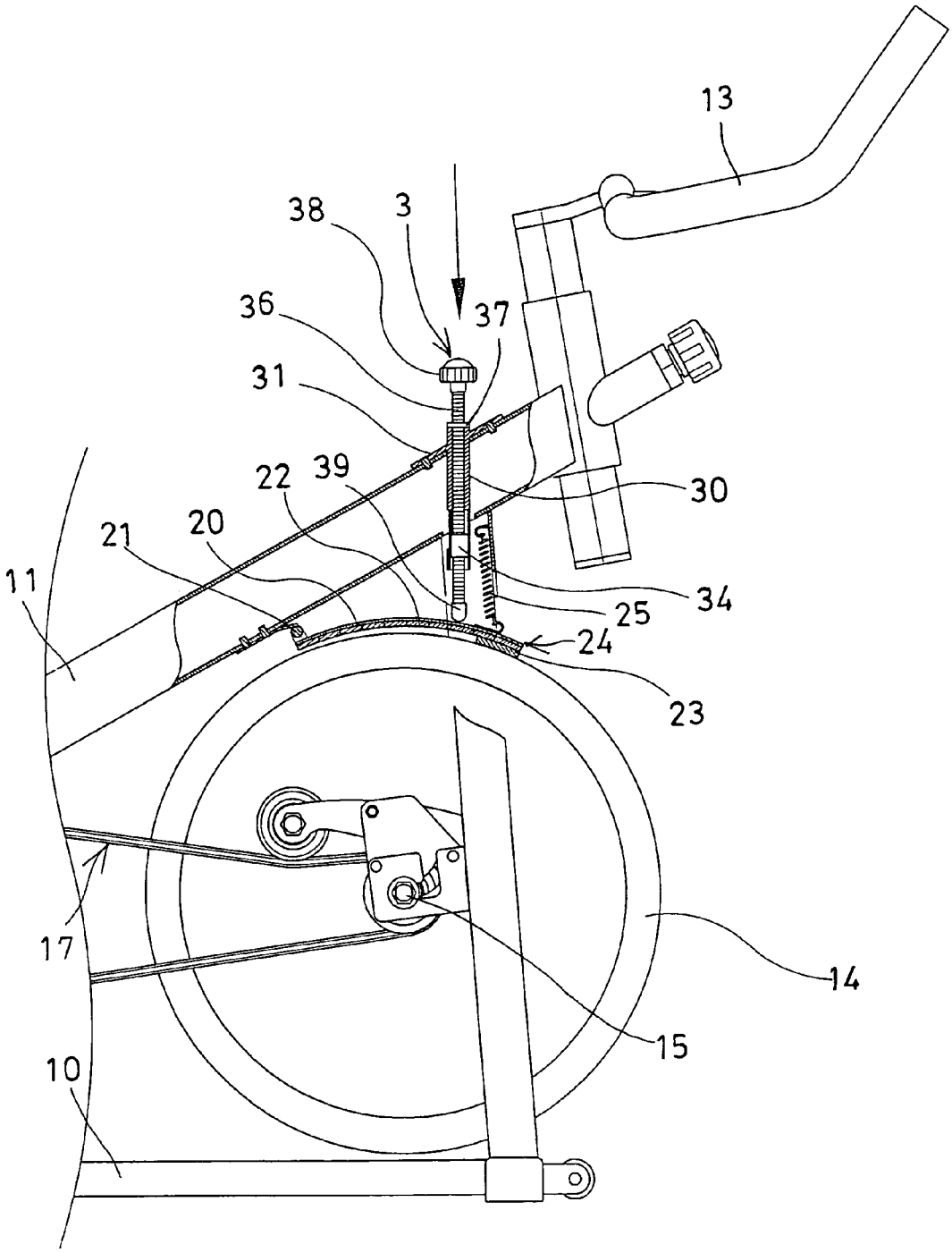

As shown in FIG. 7, due to the sliding engagement of the block 34 in the opening 33 of the barrel 30, the block 34 and thus the bolt 36 may be moved or slid up and down along the opening 33 of the barrel 30, such that the arch 20 may be forced or moved toward the flywheel 14 by directly pushing the bolt 36 downwardly toward the arch 20 and the flywheel 14, such that the brake shoe 23 of the arch 20 may be forced toward the flywheel 14 against the spring member 25 (FIG. 8), and thus to engage with and to brake the flywheel 14. The brake shoe 23 may be biased and moved away from the flywheel 14 again by the spring member 25 when the knob 38 or the bolt 36 is released by the users.

Figure 9:
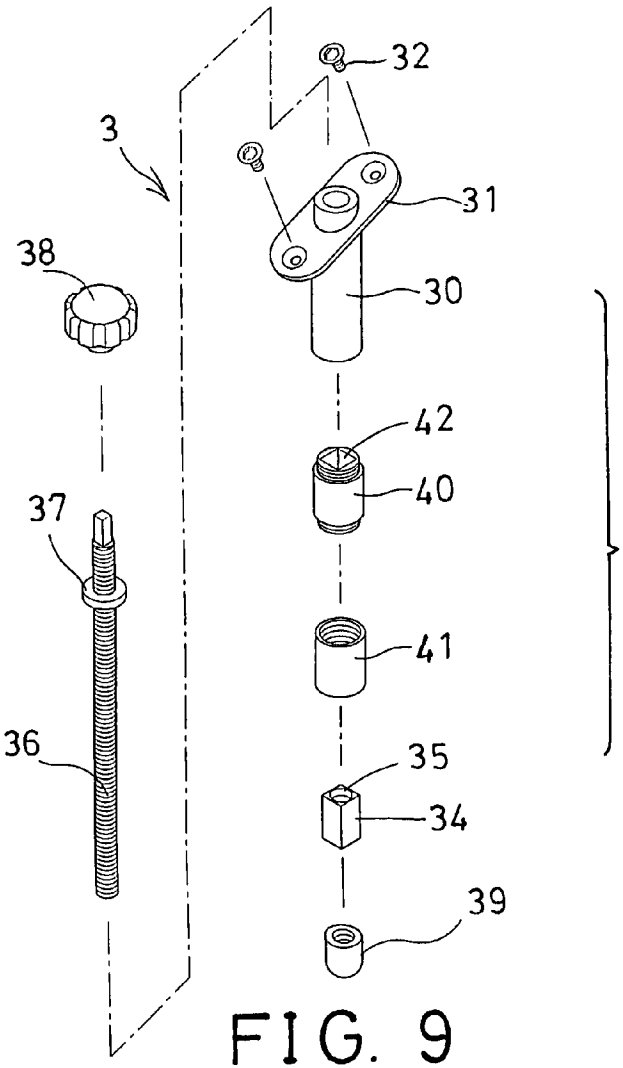
FIG. 9 is a partial exploded view illustrating the other arrangement of a magnetic retarding device for the exerciser.

Alternatively, as shown in FIG. 9, the actuating device 3 may include one or more segments 40, 41 adjustably or selectively attached to the barrel 30 with such as threading engagement, and one of the segments 40 may include a non-circular opening 42 formed therein, to slidably receive the block 34, and to prevent the block 34 from being rotated relative to the barrel 30 and the segments 40, 41.

Figure 10:
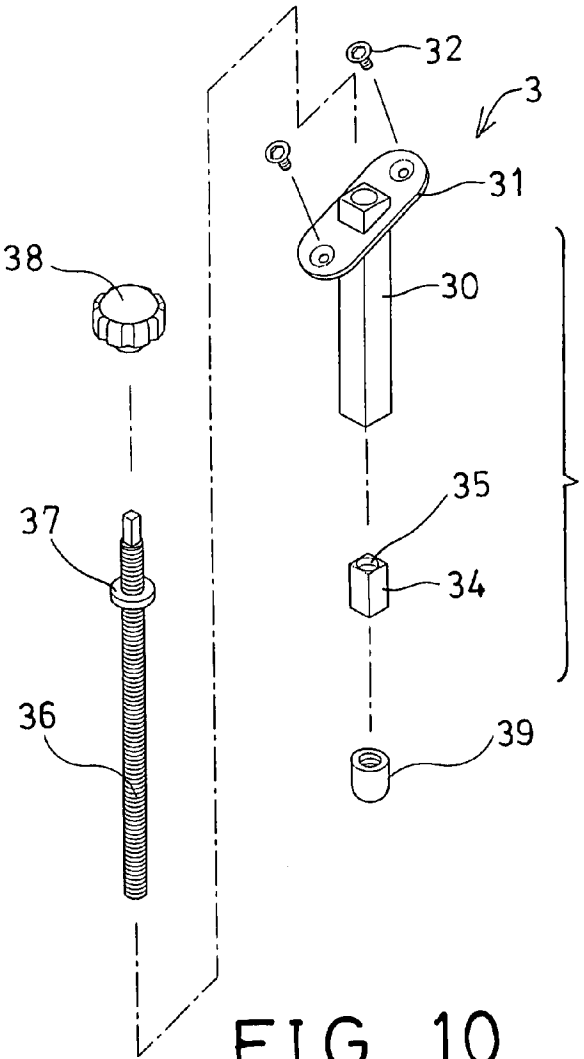
FIG. 10 is a partial exploded view similar to FIG. 9, illustrating a further arrangement of the magnetic retarding device for the exerciser.

Further alternatively, as shown in FIG. 10, the barrel 30 may include a non-circular bore formed therein and having a non-circular cross section corresponding to that of the block 34, for slidably receiving the non-circular block 34 therein, and for preventing the block 34 from being rotated relative to the barrel 30, but to allow the block 34 to slide up and down along the non-circular bore of the barrel 30.

Accordingly, the exerciser in accordance with the present invention includes a magnetic retarding device for applying a magnetic retarding or resisting force against a flywheel, in order to allow users to suitably operate the exerciser with different strength, and in addition, the magnetic retarding device is capable of being forced onto and engaged onto the flywheel selectively, in order to apply a solid brake force to brake the flywheel.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a frame, a flywheel rotatably attached onto and supported on said frame with a spindle, a pair of foot pedals, a transmission device coupling said foot pedals to said spindle of said flywheel, to allow said flywheel to be driven by said foot pedals, an arch including a first end rotatably coupled to said frame with a pivot pin, and including a second end, at least one magnetic member attached to said arch and moved in concert with said arch, to allow said at least one magnetic member to apply magnetic retarding force against said flywheel, said arch being rotatable and movable toward or away from said flywheel, to adjust said at least one magnetic member toward or away from said flywheel, and to adjust the magnetic retarding force applied to said flywheel, a brake shoe attached to said second end of said arch, and movable toward or away from said flywheel together with said arch, to selectively engage with and to brake said flywheel, means for biasing said arch and said brake shoe away from said flywheel, to resiliently space said brake shoe away from said flywheel, and to allow said brake shoe to be moved toward and against said flywheel and to brake said flywheel against said biasing means, and an actuating device slidably attached to said frame, and engageable with said arch, to selectively move and force said brake shoe of said arch to engage with and to brake said flywheel.

2. The exerciser as claimed in claim 1, wherein said actuating device includes a barrel engaged into a hole of said frame, and secured to said frame with fasteners.

3. The exerciser as claimed in claim 2, wherein said barrel includes a fastener flange extended therefrom and secured to said frame with the fasteners.

4. The exerciser as claimed in claim 2, wherein said barrel includes a non-circular opening formed therein, and said actuating device includes a non-circular block slidably engaged into said non-circular opening of said barrel, and arranged for allowing said block to slide along said non-circular opening of said barrel, but to prevent said block from being rotated relative to said barrel.

5. The exerciser as claimed in claim 4, wherein said block includes a screw hole formed therein, to thread with said bolt, and to allow said bolt to be rotated and adjusted relative to said barrel and said block.

6. The exerciser as claimed in claim 4, wherein said bolt includes a stop for engaging with said barrel, and for limiting a sliding movement of said bolt relative to said barrel.

7. The exerciser as claimed in claim 4, wherein said bolt includes a knob secured on top thereof, for rotating said bolt relative to said block, and for moving said bolt and said block relative to said barrel.

8. The exerciser as claimed in claim 4, wherein said bolt includes a cap attached to bottom for engaging with said arch.

* * * * *